US005413353A

United States Patent [19]

Demarest et al.

[11] Patent Number: 5,413,353

[45] Date of Patent: May 9, 1995

[54] METHOD OF PLAYING A BLACKJACK TYPE CARD GAME

[76] Inventors: Phillip W. Demarest, 1291 Beeler St., Aurora, Colo. 80110; R. Rick Allen, 1711 S. Nome Way, Aurora, Colo. 80012

[21] Appl. No.: 213,869

[22] Filed: May 2, 1994

[51] Int. Cl.[6] ..... A63F 1/00

[52] U.S. Cl. ..... 273/292; 273/309

[58] Field of Search ..... 273/292, 274, 309, 85 CP

[56] References Cited

U.S. PATENT DOCUMENTS

| | | | |
|---|---|---|---|
| 3,796,433 | 3/1974 | Fraley et al. | 273/138 A |
| 4,836,553 | 6/1989 | Suttle et al. | 273/292 |
| 4,861,041 | 8/1989 | Jones et al. | 273/292 |
| 5,013,049 | 5/1991 | Tomaszewski | 273/292 |
| 5,078,405 | 1/1992 | Jones et al. | 273/309 |
| 5,174,579 | 12/1992 | Griffiths | 273/292 |
| 5,257,789 | 11/1993 | LeVasseur | 273/309 |
| 5,257,810 | 11/1993 | Schorr et al. | 273/292 |
| 5,275,415 | 1/1994 | Wisted | 273/292 |

*Primary Examiner*—Benjamin H. Layno
*Attorney, Agent, or Firm*—Duane Burton

[57] ABSTRACT

A method of playing a blackjack type of card game in which the players play against one another rather than against a dealer. Initially, each player places an identical wager to form a pot and then receives two cards face down from a dealer. The dealer receives no cards but the house collects a rake from each pot. A player may split pairs, draw additional cards or stand. A player receiving a blackjack on the first two cards (i.e., ace and ten value card) or scoring the highest card sum without exceeding 21 wins the pot. If two or more players receive a blackjack on the first two cards, all tie, and the game is repeated using the same pot. If two or more players achieve the same card sum, then a predetermined schedule may be used to ascertain that all tie, and the game is repeated using the same pot.

18 Claims, 1 Drawing Sheet

METHOD OF PLAYING A BLACKJACK TYPE CARD GAME

FIELD OF THE INVENTION

The present invention relates to casino or cardroom gaming and more particularly to a method of playing a blackjack type card game.

BACKGROUND OF THE INVENTION

The game of "Blackjack or "Twenty-One" is perhaps the most popular card game played in gaming establishments throughout the united states. This game is played with a standard deck of playing cards containing fifty-two cards in four suits. The object of the game is to achieve a count of twenty-one without going over twenty-one (i.e., "busting"). Numbered cards (i.e., 2–10) count as their face value and face cards (i.e., king, queen, jack) count as ten. An ace counts as either one or eleven.

Blackjack is typically played at tables that include a dealer and up to seven players. Each player is playing against the dealer or "house". Each player places a bet and along with the dealer initially receives two cards. In order to win his bet, a player must have a higher point total than the dealer without going over twenty-one. A player may draw additional cards (i.e., take "hits") or stand on the cards at his discretion. Since the dealer receives one of his two initial cards face down (i.e., "hole card"), the players know only half of the dealer's initial hand. This adds an element of uncertainty to a player's decision to take a hit or to stand. The risk of busting with an additional card increases as the players point total approaches twenty-one. A player increases the probability of beating the dealer by hitting or standing on a particular card situation.

The dealer, however, must take a hit on any point total of sixteen or less and must stand on any point total of seventeen or more. A Blackjack occurs when a player or the dealer receives an ace and a face card or ten. A Blackjack by a player typically pays one and one-half of the player's bet. A Blackjack by the dealer ends the game causing each player to loose his bet.

The game of Blackjack has changed little over the years. One aspect of the game that tends to irritate players, however, is that although each player opposes the dealer individually, each player's game is affected by the play of the other players. This often works to a good player's disadvantage at a table with inexperienced or unskilled players. Inexperienced players, for instance, may elect to hit or stand at inappropriate times. A player may draw a card that hurts not only himself but also the other players. As an example, a player may draw a ten which causes the player to bust and at the same time deprives the dealer of the card which would have caused the dealer to bust.

In view of this it would be desirable to have a Blackjack type game in which the individual players are pitted against one another. A skillful player could thus take advantage of the weaknesses of the opposing players. Moreover the slight advantage in odds that goes to the house could be used to the player's advantage.

Accordingly, it is an object of the present invention to provide a Blackjack type game in which the players play against one another rather than against a dealer. It is another object of the present to provide a Blackjack type game which provides revenue for a house or casino while allowing the players to play against one another. It is yet another object to provide a Blackjack type game that is simple to play, enjoyable and similar in most respects to conventional Blackjack.

SUMMARY OF THE INVENTION

In accordance with the present invention, a method of playing a Blackjack type card game is provided. The method of the invention simply stated comprises a Blackjack type game in which the players play against one another. To play the game, a pot is formed by each of the players wagering a predetermined amount. Hands are then dealt by a dealer to each of the players in a manner substantially similar to conventional Blackjack. The dealer does not play but merely deals the cards.

Initially each player is dealt two cards face down. Each of the remaining cards is dealt face up. After receiving the first two cards a player may split pairs, draw additional cards or stand. Following the deal, and any subsequent draws by the players, a showdown is initiated by the dealer turning over each players cards and announcing the card sums. A winning hand held by a player collects the pot minus a predetermined rake collected by the house. If two or more players have equivalent hands, it is a tie, and the pot is split equally between the tying players. If the pot cannot be split equally between the tying players then all the players tie, and another hand is dealt using the same pot. In the case of a tie no rake is collected by the house. Whether or not a tie occurs is dependent on the total number of players in a game and the number of players tying. In addition, if two or more players receive a blackjack on the first two cards then all tie.

Following completion of the game and the pay out to the winner or winners, another game is initiated. The starting point of the deal moves in a clockwise direction around the playing table according to an imaginary dealer "button". This helps to equalize odds between the players over the course of several games.

A game played in accordance with the invention is termed "Jack Attack". This game may be played by three to seven players and a dealer at a special gaming table. In addition, "shills" or "props" may be employed by the house to insure an adequate number of players. The game, broadly stated, includes the steps of: each player placing a predetermined wager to form a pot; a dealer dealing a hand of "Jack Attack" to each of the players; and, the winning hand or hands collecting the pot minus a predetermined rake paid to the house.

Various objects, advantages and capabilities of the present invention will become more apparent from the following more particular description of the preferred embodiments of the invention as illustrated in the accompanying drawings.

DETAILED DESCRIPTION OF THE PREFERRED EMBODIMENTS

Figure 1:
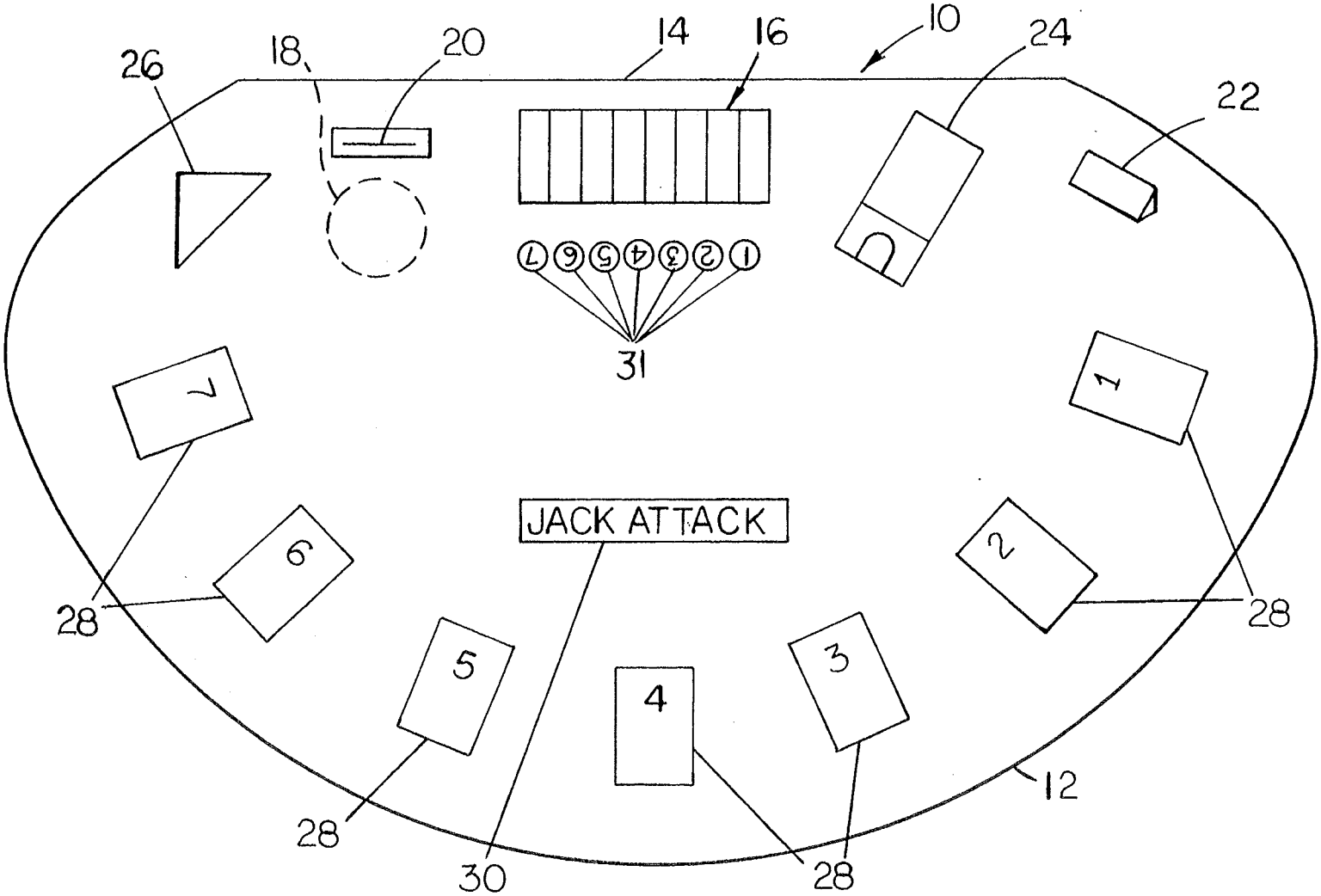
FIG. 1 is a plan view of a playing table suitable for playing Jack Attack in accordance with the method of the invention.

The version of the present invention to be employed at gaming establishments is referred to herein as "Jack Attack". The method of the invention will be described with reference to a gaming table 10 having a specific layout as illustrated in FIG. 1. The gaming table 10 is formed with a felt surface as is customary with card tables. The gaming table 10 includes a semicircular players' area 12 wherein the players sit or stand and a dealer's area 14 wherein the dealer sits or stands. In the illustrative embodiment there are seven wager area 28 numbered 1–7 for the players corresponding to locations on the table for the seven players to place wagers. The wager areas 28 are formed as rectangular blocks outlined on the felt surface of the gaming table 10. At least three players are required to play Jack Attack.

The gaming table 10 includes a chip rack 16 having slots for retaining chips, tokens or coins that are placed in the rack by the dealer during the course of play. The gaming table lay-out includes seven circles numbered 1–7 each of which is assigned to a player. The area occupied by the circles 1–7 is termed herein as the wager pool area 31. The wager pool area 31 is used during the game in calculating and distributing a pot to one or more winning players and forming a wager pool from wagers associated with low score busts during the showdown.

In addition, an area of the gaming table 10 such as area 18 may be designated as a rake area. Chips, tokens or coins that make up the rake are pulled by the dealer from the pot and placed in an obvious manner in the rake area 18. At the completion of a game the rake is placed by the dealer into a drop slot 20. The drop slot 20 communicates with a drop box (not shown) mounted to the underside of the gaming table which collects the rake for the house.

The gaming table 10 also includes a card shoe 24 for holding shuffled cards to be dealt and a discard rack 26 for holding the cards that have been played. The card shoe 24 is placed on the gaming table 10 on the left hand of the dealer. The card shoe 24 may be constructed in a conventional manner as a spring-loaded magazine which retains one or more decks of cards for dealing one card at a time. Jack Attack can be played with one or several standard decks of cards. A standard card deck includes 52 cards in four suits (hearts, diamonds, clubs, and spades) with each suit consisting of numerical cards from 2 to 10 along with a jack, a queen, a king and an ace.

The discard rack 26 is placed on the gaming table on the right hand of the dealer. The discard rack 26 may be constructed as is conventional in the art as a right angle structure open on one side and arranged for retaining a stack of cards. A set of printed rules 22 for Jack Attack is also placed on the gaming table 10. In addition, the gaming table 10 may include a "Jack Attack" inscription 30 printed on the surface thereof.

Prior to initiation of a game each player places a wager in his corresponding wager area 28. Each player must place the same wager. As an example the wager can be $2, $3, $4, $5, $10, $25, $50, $100 or more than $100. The Jack Attack game is initiated by the dealer dealing each player two cards face down. (Alternately only one of the two dealt cards can be face down and one can be face up.) The order of the deal is clockwise around the table. The starting point of the deal moves around the table for each new game with an imaginary dealer "button". The dealer does not receive any cards. After two cards have been dealt to each player, each player may split pairs, draw or stand. No double down is permitted. As each player indicates a decision, the dealer must deal face up whatever additional cards are necessary. Again, the order of play is in a clockwise direction.

A player wins the total amount wagered from all other players (i.e., pot) less rake if the sum of the player's cards exceeds that of the other players without exceeding 21. Alternately a player wins if he has a Jack Attack and the other players do not. A Jack Attack corresponds to a Blackjack and comprises an ace and a card having a ten value dealt on the first two cards. A player may elect to draw additional cards if the player's point count is less than 21. A player with Jack Attack, or a hard or soft total of 21, may not draw additional cards.

When the last player has been dealt cards a showdown is initiated. Starting with the player to the right of the button and continuing clockwise, the dealer reveals the cards and announces the sums to the table. The wagers corresponding to the larger card sums (in case of ties) remain in place, while wagers corresponding to card sums of lesser value are removed to the wager pool 31 to form a wager pool for distribution to the winner/-winners at the completion of the hand. Cards for the players having card sums of lesser value are removed and placed in the discard rack 26.

In the event a player's card sum is equal to one or more other player's card sums, the pot is divided equally between them. In case of a tie and depending on the method or schedule used, a rake may or may not be taken and the all tie rule may apply. A schedule, such as the following "Schedule A", can be provided for determining payoffs and rake amounts. "All ties" pushes are also demonstrated on Schedule A.

Schedule A
Wager Pay-off and Rake
$5.00 Table
Example Using A 10% Rake

| | |
|---|---|
| 7 players 1 winner: | $26.50/$3.50 |
| 7 players 2 winners: | 10.75/$3.50 |
| 7 players 3 winners: | 5.50/$3.00 |
| 7 players 4–7 ties all tie/no rake | |

As an example, for seven players playing with a $5 wager, the payoff to a single winning player would be $26.50 and the rake (10%) would be $3.50. If two players have the same card sum, the pay off would be $10.75 for each winning player. For three players having the same card sum, the payoff would be $5.50 for each winning player. If four to seven players have the same card sum, the all tie rule would be in effect. In that case no rake would be taken and another hand would be dealt using the same wagers.

Other predetermined schedules may be used to ascertain payoff amounts, rake amounts and whether or not the all tie rule applies. As another example, the schedule may specify that for five players, if two or three players have tying card sums the pot is split equally. If four, five or six players have tying card sums the all tie rule applies. For four players, the schedule may specify that if two players have tying card sums the pot is split equally. If three or four players have tying card sums the all tie rule applies.

In some cases the house may employ props or shills to insure that enough players are present to allow Jack Attack to be played. No more than two props or shills may play in any one game.

A detailed set of rules for Jack Attack is as follows.

RULES FOR JACK ATTACK

The game of Jack Attack, when authorized, shall be permitted and conducted according to the rules (hereinafter collectively called "the rules of Jack Attack"). The rules of Jack Attack shall be followed by all licensees and by all persons participating in any game of Jack Attack.

The following definitions apply to all the rules of Jack Attack and to all games of Jack Attack conducted by licensees:

1. "Jack Attack/Blackjack" means an ace and a second card with a point value of ten dealt as the initial two cards to a player. Blackjack may not include an ace and a ten-point-value card dealt to a player who has split pairs.
2. "Button" means an object which is moved clockwise around the table to denote an imaginary dealer.
3. "Deal" means the distribution of the playing cards among the players.
4. "Dealer" means the person responsible for dealing the cards at a Jack Attack table.
5. "Hard Total" means the total point count of a hand which contains no aces or which contains aces that are counted as one in value.
6. "Pot" means the total amount wagered by the players in a game.
7. "Prop" a person paid a fixed sum by the licensee for the specific purpose of laying the card games, who uses his own funds and retains his winnings and absorbs his losses. No more than two props may play in a card game.
8. "Rake" or "Rake off" means the amount taken from the pot by the house. The rake percentages can be calculated as:
   a. a percentage of the winning pot.
   b. a percentage of a broke hand.
   c. an ante.
9. "Shoe" means a dealing device that has a compartment in which cards are stacked and which permits cards to be dealt at any given time.
10. "Shill" means a person who promotes Jack Attack in accordance with the licensee's policy and regulations. Each shill is responsible for the money extended to him at the beginning of his shift. No more than two shills may play in one game.
11. "Showdown" means the revealing of each player's hand in order by the dealer after the last card has been dealt to determine the winner(s).
12. "Soft total" means the total point count of a hand containing an ace when the ace is counted as eleven in value.
13. "Wager Pool" means an interim amount collected by the dealer during the course of play from players having card sums of lesser value or who have busted.

Jack Attack may be played only on tables displaying the Jack Attack layout. In addition to any special markings utilized by the game, the inscriptions required shall appear on the cloth covering the Jack Attack table.

The value of the cards contained in a deck of cards is as follows:

1. A card from 2 to 10 has its face value;
2. A jack, queen, or king has a value of 10; and
3. An ace has a value of 11 unless that would give a player a score in excess of 21, in which case it has a value of one;

A standard Jack Attack deck shall contain 52 cards in four suits (hearts, diamonds, clubs, and spades) with each suit consisting of numerical card from 2 to 10 and a jack, a queen, a king and an ace. More than one deck of cards may be used for Jack Attack.

Before the first card is dealt for a round of play, a player may make a wager of not more than set table limits.

Players Wagering on More Than One Box

A licensee may permit a player to wager on more than one box (i.e., wager area) or may limit multiple play during hours when there are insufficient seats in an establishment to accommodate patron demand. The "All Tie" Jack Attack rule may not be violated. All players must wager equal amounts, the amount being set by licensee, i.e., $2.00 table, $5.00 table, $10.00 table, $50.00 table, etc. The player wins the total amount wagered from all other players, less rake, if any of the following events occur:

1. The sum of the player's cards is 21 or less.
2. The sum of the player's cards exceeds that of the other players without exceeding 21; or
3. The player has Jack Attack and the other players do not.

Jack Attack

Once all cards have been dealt, if any player(s) has been dealt a Jack Attack, i.e., blackjack, he must reveal it by turning his cards over immediately upon dealer's call and before any additional cards are dealt to any player. This will end the round of play, and depending on the number of players, the pay-off will be at least 2-1. If there is a tie (any two Jack Attacks), it is considered a push for all players.

The Deal

At the beginning of the round of play, cards are dealt starting to the right of the button and continuing clockwise around the table in the following order:

1. One card face downward to each wager box (i.e. wager area) in which a wager is contained on the layout (no cards to the dealer);
2. A second card, face downward to each wager box in which a wager is contained;

The Play

After two cards have been dealt to each player, each player may split pairs, draw or stand. As each player indicates a decision, the dealer must deal face up whatever additional cards are necessary.

Drawing of Additional Cards by Players

A player may elect to draw additional cards if the player's point count total is less than 21. A player with Jack Attack or hard or soft total of 21 may not draw additional cards.

Except when splitting pairs, no wager may be increased or withdrawn after the first card of a round has been dealt. All wagers of Jack Attack must be made by placing gaming chips tokens or coins in the appropriate areas of the Jack Attack layout.

Splitting Pairs

If the first two cards dealt to a player are identical in value, the player may split the hand into two separate hands by making a wager on the second hand equal to the player's original wager. If a player splits pairs, the dealer must deal a second card to the first hand so formed and must complete the player's decision on that hand before dealing cards to the second hand. After a second card is dealt to a split pair, the player must stand or draw. A player may not split pairs more than three times in a round of play on any one hand. A player splitting aces may have only one card dealt to each ace, face upward or downward according to licensee's discretion.

Except for splitting pairs, once the first card of the hand has been dealt by the dealer, no player may handle, remove or alter any wagers that have been made until the hand has been completed. After a wager to split pairs has been confirmed by the dealer, no player may handle, remove or alter the wagers until the hand is completed. No dealer or other employee of the licensee may permit a player to violate this section.

Doubling Down Does Not Apply

Doubling down occurs in conventional blackjack when a player doubles his wager and receives only one additional card.

Irregularities

A card found turned upward in the shoe or deck may not be used in the game and must be placed in the discard rack. A card drawn in error without it's face being exposed must be used. After the initial two cards have been dealt to each player and a card is drawn in error and exposed to the players, the card must be dealt to the player. Any player refusing to accept such a card may not have additional cards dealt to such player during the round. If the card is refused by the player, the card must be burned. If there are insufficient cards remaining the shoe or deck to complete the round of play the cards in the discard rack must be shuffled and cut, and the dealer must complete the round of play. If no cards are dealt to a player's hand, the hand is dead, and the player may be included in the next deal. If only one card is dealt to the player's hand, the dealer must deal the second card to the player after all other players have received a second card.

Cards are dealt to all players, and all player hands are played out during the round of play. However, as wins and losses are determined, losing wagers are collected and placed into the wager pool. Losing cards are placed in the discard rack. Winning wager(s) are paid off from the wager pool only at the end of the round of play.

Showdown

Starting with the player to the right of the button, and continuing clockwise, the dealer reveals the cards and announces sums to the table. The larger sum or sums wagered (in case of ties) remain in place, while wager of lesser value are removed to the wager pool for distribution to the winner/winners at the completion of the hand. Card sums of lesser value are removed and placed in the discard rack.

Award of Pot

Pots must be awarded by the dealer. When the dealer has awarded the pot, and it has been taken in by a player(s) without claim against it, the award stands. A game must be played to conclusion and the pot awarded to the winning player except in the case of ties or pushes.

In the event a player's card sum is equal to another player's, the pot is divided equally among them. All ties pushes are demonstrated on Schedule A. With all ties pushes, all players have their wagers returned from the wager pool. Rake may or may not be taken dependent on which method or schedule is used.

Winning wagers will be paid in accordance with a predetermined schedule. See Schedule A as an example.

Rake Offs

Rake offs may not exceed the percentages of method(s) used. Rake-offs may be pulled from the pot only by the dealer in an obvious manner at the completion of the hand. The rake-off must be placed in a designated rake area until a winner(s) is declared and paid. The rake-off must then be dropped into the drop box. The designated rake area must be clearly visible to all players.

Except as provided by the rules and regulations above, Jack Attack shall comply with all rules for blackjack play set forth by the State Gaming Commission as follows:

Inspection of cards
Presentation of cards
The shuffle and reshuffle
Cut
Cutting Player
Procedure for dealing cards
Burn procedure
The pickup
Dealing after cutting card reached
Prohibited acts
Point counts
Proposal for variations
Posting of rules
Procedure for accepting cash at blackjack table.

While the method of the invention has been described with reference to certain preferred embodiments, as will be apparent to those skilled in the art, certain changes and modifications can be made without departing from the scope of the invention as defined by the following claims.

What is claimed is:

1. A method of playing a blackjack type game using at least one standard deck of fifty two playing cards, said method comprising the steps of:

three to seven players placing a predetermined wager to form a pot;

a dealer dealing two cards to each of said players at least one of said two cards being face down;

each of said players electing in turn to stand or draw additional cards without placing an additional wager;

determining a card sum from each player's cards with a card from 2 to 10 counted at its face value, a jack, queen, or king counted as 10 and an ace counted as 11 unless that would give a total card sum in excess of 21 in which case said ace has a value of one;

comparing each player's cards and determining a winner, said winner having a card sum that does not exceed 21 but exceeds that of every other player or alternately said winner having a blackjack with said two cards and no other player having a blackjack;

after determining said winner paying said pot minus a predetermined rake to said winner; and rotating an imaginary dealer button from player to player to determine a starting point for a deal of a next game.

2. The method of playing a blackjack type game as recited in claim 1 and wherein if two or more players have a same card sum said pot is divided equally between said players.

3. The method of playing a blackjack type game as recited in claim 1 and wherein if two or more players have a same card sum, said pot is divided or all tie according to a predetermined schedule.

4. The method of playing a blackjack type game as recited in claim 1 and wherein if two or more players receive a blackjack on said two cards then all tie and another hand is dealt using said pot.

5. The method of playing a blackjack type game as recited in claim 1 and wherein there are seven players and if two or three players have tying card sums said pot is split equally between said two or three players but if four, five, six or seven players have tying card sums said pot is not divided and another hand is dealt using said pot.

6. The method of playing a blackjack type game as recited in claim 1 and wherein there are five players and if two or three players have tying card sums said pot is split equally between said two or three players but if four, five, or six players have tying card sums said pot is not divided and another hand is dealt using said pot.

7. The method of playing a blackjack type game as recited in claim 1 and wherein there are four players and if two players have tying card sums said pot is split equally between said two players but if three or four players have tying card sums said pot is not divided and another hand is dealt using said pot.

8. The method of playing a blackjack type game as recited in claim 1 and wherein there are three players and if two or three players have tying card sums said pot is not divided and another hand is dealt using said pot.

9. A method of playing a blackjack type game using at least one standard deck of fifty two playing cards, said method comprising the steps of:

three to seven players placing a predetermined wager to form a pot;

a dealer dealing a hand of two cards to each of said players with at least one of said two cards dealt face down and wherein a card from 2 to 10 is counted at its face value, a jack, queen, or king is counted as 10 and an ace is counted as 11 unless that would give a total card sum in excess of 21 in which case said ace has a value of one;

each player deciding in a predetermined order to stand or take additional cards without placing an additional wager;

comparing each player's cards and determining a winner, said winner having a card sum that does not exceed 21 but exceeds that of every other player or alternately said winner having a blackjack with said two cards and no other player having a blackjack;

after determining said winner paying said pot minus a predetermined rake to said winner and paying said predetermined rake to a house and wherein if two or more players tie and the pot cannot be split equally then all tie and another hand is dealt using said pot; and rotating an imaginary dealer button from player to player to determine a starting point for a deal of a next game.

10. The method as recited in claim 9 and wherein if two or more players each have a blackjack on said first two cards then all tie and another hand is dealt using said pot.

11. The method as recited in claim 9 and wherein both of said two cards are dealt face down.

12. The method as recited in claim 9 and wherein if said two cards are identical in value for a player then said player may split said two cards and play each separately by doubling said predetermined wager and wherein if said two cards are aces only one additional card is dealt face up for each of said aces.

13. The method as recited in claim 9 and wherein said method is played at a table that includes wager areas for each player to place a wager, a rake area for the dealer to place a rake, and a wager pool area for calculating and distributing the pot.

14. A method of playing a blackjack type game using at least one standard deck of fifty two playing cards, said method comprising the steps of:

three to seven players placing a predetermined wager to form a pot;

a dealer dealing two initial cards to each of said players with at least one of said two initial cards dealt face down and wherein a card from 2 to 10 is counted at its face value, a jack, queen, or king is counted as 10 and an ace is counted as 11 unless that would give a total card sum in excess of 21 in which case said ace has a value of one and wherein if said two initial cards are identical in value for a player then said player may split said two initial cards place another predetermined wager and play each separately and wherein if said two initial cards are aces only one additional card is dealt face up for each of said aces;

each player deciding in a predetermined order to stand or take additional cards without placing an additional wager;

comparing each player's cards and determining a winner, said winner having a card sum that does not exceed 21 but exceeds that of every other player or alternately said winner having a blackjack with said two cards and no other player having a blackjack;

after determining said winner paying said pot minus a predetermined rake to said winner and paying said predetermined rake to a house and wherein all tie and another hand is dealt using said pot if two or more players tie and the pot cannot be split equally or said two initial cards for two or more players are blackjacks; and rotating an imaginary dealer button from player to player to determine a starting point for a deal of a next game.

15. The method of playing a blackjack type game as recited in claim 14 and wherein said method is played at a table lay-out having a wager area for each player to place a wager, a rake area for the dealer to place a rake and a wager pool area for calculating and distributing the pot.

16. The method of playing a blackjack type game as recited in claim 15 and wherein said predetermined wager is selected from the group consisting of $2, $3, $4, $5 $10, $25, $50, $100, or more than $100.

17. The method of playing a blackjack type game as recited in claim 16 and wherein both of said initial two cards are dealt face down.

18. The method of playing a blackjack type game as recited in claim 17 and wherein a player is not allowed to double down on said first two cards.

* * * * *